US005901842A

United States Patent [19]

Berger

[11] Patent Number: 5,901,842

[45] Date of Patent: May 11, 1999

[54] PAD HOLDER INSERT

[75] Inventor: Barry David Berger, New York, N.Y.

[73] Assignee: American Trading and Production Corporation, Baltimore, Md.

[21] Appl. No.: 08/099,090

[22] Filed: Jul. 29, 1993

[51] Int. Cl.[6] ..... B65D 69/00

[52] U.S. Cl. ..... 206/232; 206/472; 206/305

[58] Field of Search ..... 206/232, 472, 206/473, 305, 455

[56] References Cited

U.S. PATENT DOCUMENTS

| | | | |
|---|---|---|---|
| D. 241,381 | 9/1976 | Garnier | 206/305 X |
| 676,756 | 6/1901 | Miller | 206/472 X |
| 2,732,842 | 1/1956 | Loudon | 206/472 X |
| 3,216,135 | 11/1965 | Wright | 206/232 X |
| 3,913,740 | 10/1975 | Bisberg | 206/472 |
| 4,306,737 | 12/1981 | Errichiello | 206/472 X |
| 4,768,648 | 9/1988 | Glass | 206/305 X |
| 4,932,520 | 6/1990 | Clarcia et al. | 206/232 |
| 4,974,983 | 12/1990 | Givati | 206/232 X |
| 5,031,772 | 7/1991 | Woodriff | 206/444 |
| 5,105,338 | 4/1992 | Held | 206/305 X |
| 5,224,599 | 7/1993 | Uchida | 206/472 X |

*Primary Examiner*—Ted Kavanaugh
*Attorney, Agent, or Firm*—Seidel, Gonda, Lavorgna & Monaco, PC

[57] ABSTRACT

An insert for a pad holder and the like includes a tongue for insertion into an inside pocket of a cover of the pad holder, the inside pocket being intended to receive a back of a pad of paper, and a flap hingedly joined to said tongue along an upper edge thereof. The flap overlies the inside pocket when the tongue is inserted into the pocket and allows the back of a pad of paper to be inserted into the pocket along with the tongue, whereby the pad of paper overlies the flap. The insert further includes holder means for holding and storing articles, the holder means being hingedly joined to the flap along a side edge thereof and pivotable with respect to the flap, whereby the holder means is also pivotable with respect to the pad of paper when the pad of paper is inserted into the inside pocket. The holder means lies between the pad of paper and an opposed cover of the pad holder when the pad of paper is inserted into the inside pocket.

16 Claims, 10 Drawing Sheets

FIG. 1
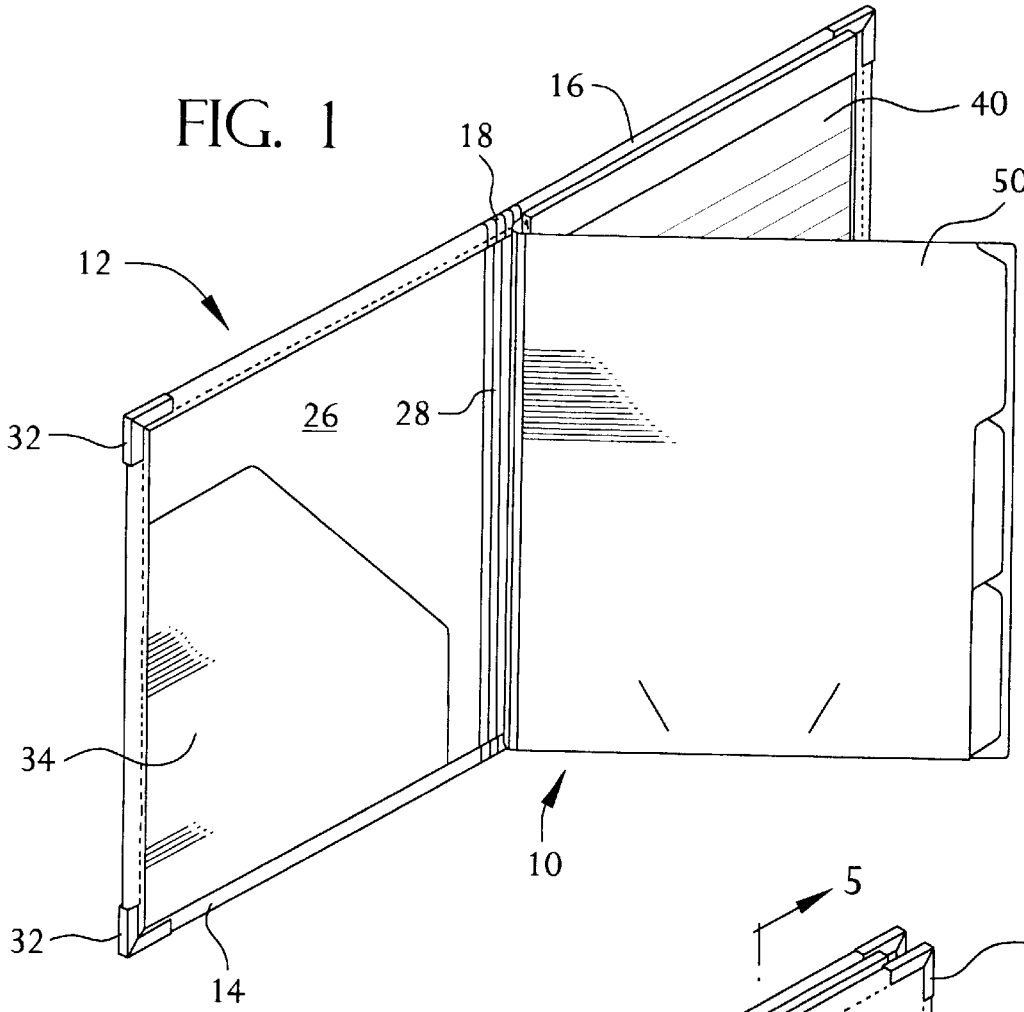
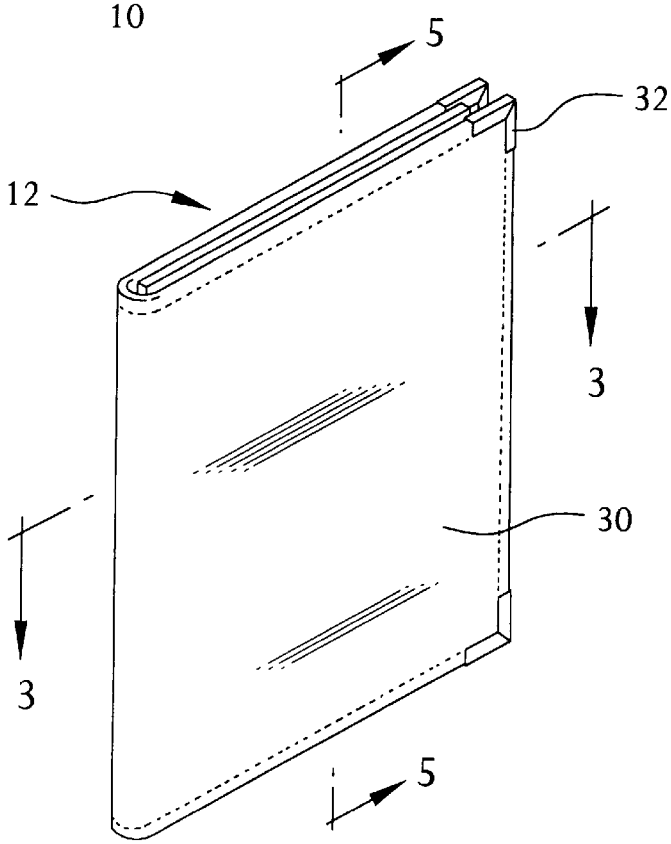
FIG. 2

FIG. 9
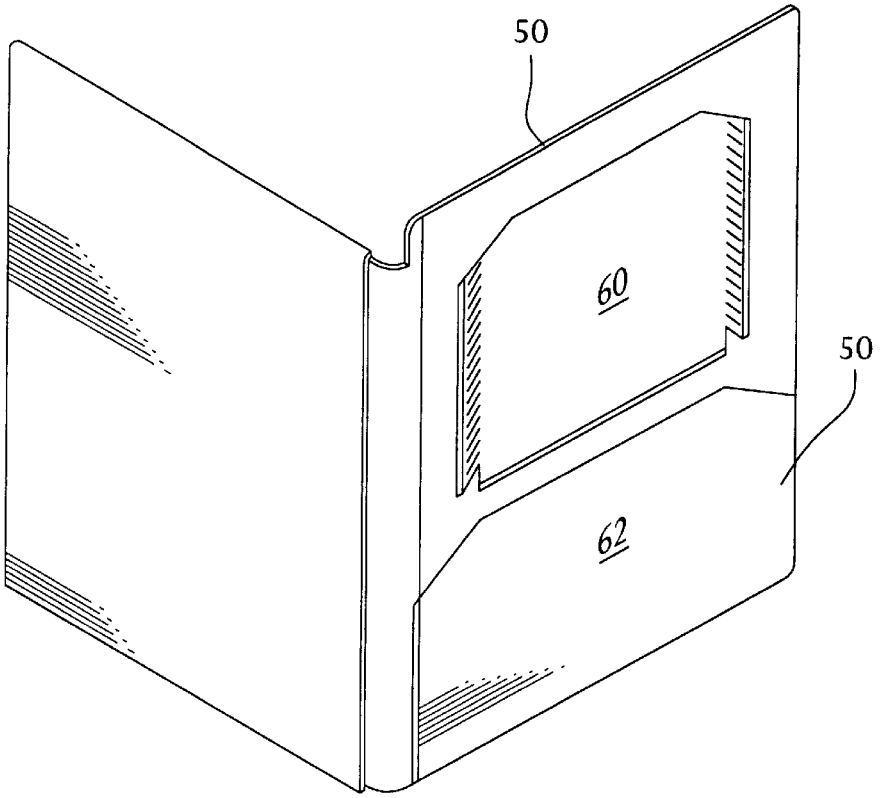
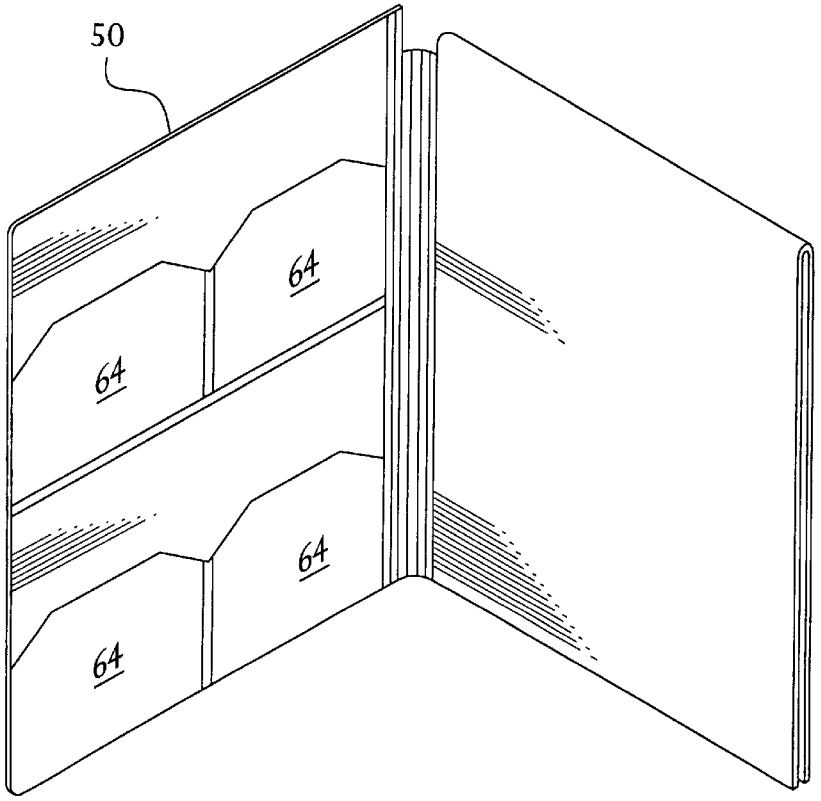
FIG. 10

PAD HOLDER INSERT

FIELD OF THE INVENTION

The present invention relates to inserts for pad holders and the like, and in particular to inserts which can be placed in a standard pad holder designed to hold a cardboard-backed pad of paper without interfering with use of the pad and other standard features of the pad holder.

BACKGROUND OF THE INVENTION

Pad holders are staple items of stationery and are widely used to carry pads of paper as well as loose papers and other items. As is well known, a typical pad holder consists of front and back covers joined by an integral hinge. In most cases, the front and back covers are made of a stiff cardboard material and are sandwiched between two layers of leather, vinyl, cloth or other suitable covering material. The covering material typically extends over both the front and back covers, and the portion of covering material between the front and back covers forms the integral hinge. A slit is usually provided near the top of the inside back cover of sufficient length to receive the backer of a pad of paper between the inside back covering material and the stiff cardboard of the back cover. Thus, a pad of paper may be inserted and retained in the pad holder and removed and replaced as desired.

Such pad holders also typically have a flap pocket on the inside front cover to hold loose papers and other items such as tickets and so forth, and may also have additional small pockets on the outside of the flap pocket to bold business cards. A pen or pencil loop is also often provided along the inside of the hinge.

An advantage of a typical pad holder is that it is fairly light and easily carried. A disadvantage of the typical pad holder is that it does not have a great capacity for holding much more than a pad of paper and a few loose sheets. A typical flap pocket cannot accommodate a large number of papers. Moreover, the typical pad holder usually has no room to store other items such as a calculator, an appointment book, a personal telephone directory, keys, and other items one finds necessary. Consequently, the typical pad holder is of limited utility, and one must usually also carry a portfolio or briefcase to hold these other items.

There is a need for a pad holder insert which can provide additional storage in a typical pad holder so as to enable the user to store and carry additional items in the pad holder without the need to resort to a portfolio or briefcase. Such an insert should preferably be available in a number of different configurations to hold a variety of different items, such as computer diskettes, a calculator, keys and coins, and so forth. It is desirable that such an insert be easily inserted and that it not interfere with the use of the pad of paper, inside flap pocket, and other standard features of the pad holder. It is also desirable that such an insert be easily removable for those times when it is not needed, or so that it can be replaced with a different insert adapted to hold different items as the user may desire.

The present invention achieves these goals. The present invention provides an insert which is easy and inexpensive to produce, offers a wide variety of storage capabilities, is easy to insert and remove, and supplements rather than interferes with the standard features of the pad holder into which it is inserted.

SUMMARY OF THE INVENTION

The present invention is an insert for a pad holder and the like. The insert comprises a tongue for insertion into an inside pocket of a cover of said pad holder, said inside pocket being intended to receive a back of a pad of paper; a flap hingedly joined to said tongue along an upper edge thereof, said flap overlying said inside pocket when said cover when said tongue is inserted into said pocket and allowing said back of a pad of paper to be inserted into said pocket along with said tongue, whereby said pad of paper overlies said flap; and holder means for holding and storing articles, said holder means being hingedly joined to said flap along a side edge thereof and pivotable with respect to said flap, whereby said holder means is also pivotable with respect to said pad of paper when said pad of paper is inserted into said inside pocket, said holder means lying between said pad of paper and an opposed cover of said pad holder when said pad of paper is inserted into said inside pocket.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 1 is an isometric view of an insert according to the invention, in conjunction with a typical pad holder.

FIG. 2 is an isometric view of the pad holder of FIG. 1 in the closed position.

FIGS. 7 and 8, 9 and 10, 11 and 12, and 13–17 illustrate four different embodiments of insert according to the invention.

DESCRIPTION OF THE INVENTION

Figure 3:
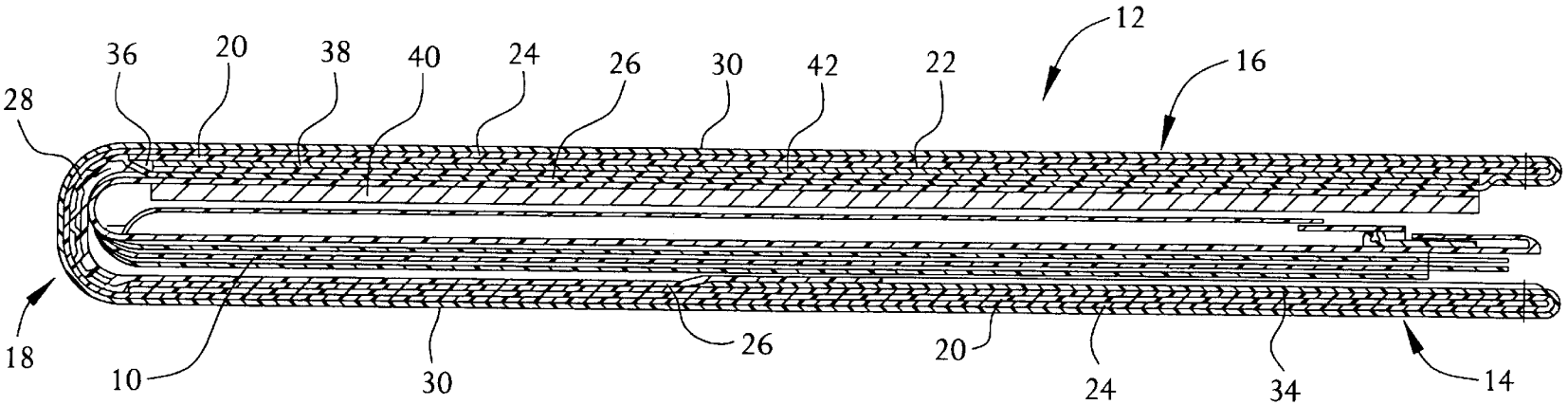
FIGS. 3 and 4 are sectional views taken along the line 3—3 in FIG. 2, FIG. 3 illustrating a single insert and FIG. 4 illustrating two inserts.

Referring now to the drawings, wherein like numerals indicate like elements, there is shown an insert 10 according to the invention, in conjunction with a typical pad holder 12. Pad holder 12 is conventional, and comprises a front cover 14 and a back cover 16 joined together by an integral hinge 18. As those skilled in the art will understand, front and back covers 14 and 16 consist of a stiff cardboard core 20 and 22, respectively, sandwiched between outer and inner layers 24 and 26 of a plastic material, such as vinyl. Layers 24 and 26 are joined together at about their centers along a plurality of heat seals 28, to form integral hinge 18. Outer layer 24 is, in turn, covered by a skin 30 of suitable material such as leather, cloth, and the like. This gives the pad holder 12 an elegant appearance and conceals integral hinge 18 from the outside. The edges of skin 30 are folded over and sewn around the perimeter of pad holder 12, and the corners of pad holder 12 may be fitted with metal or other corner protectors 32. A flap pocket 34 may be provided on the inside of one of the covers, such as on the inside of front cover 14.

A slit in inner layer 26 on one of the covers, such as back cover 16, defines a pocket 36 between the cardboard core 20 and inner layer 26. The pocket 36 is intended to receive the back 38 of a pad of paper 40.

As described so far, the structure of pad holder 12 is conventional.

Figure 8:
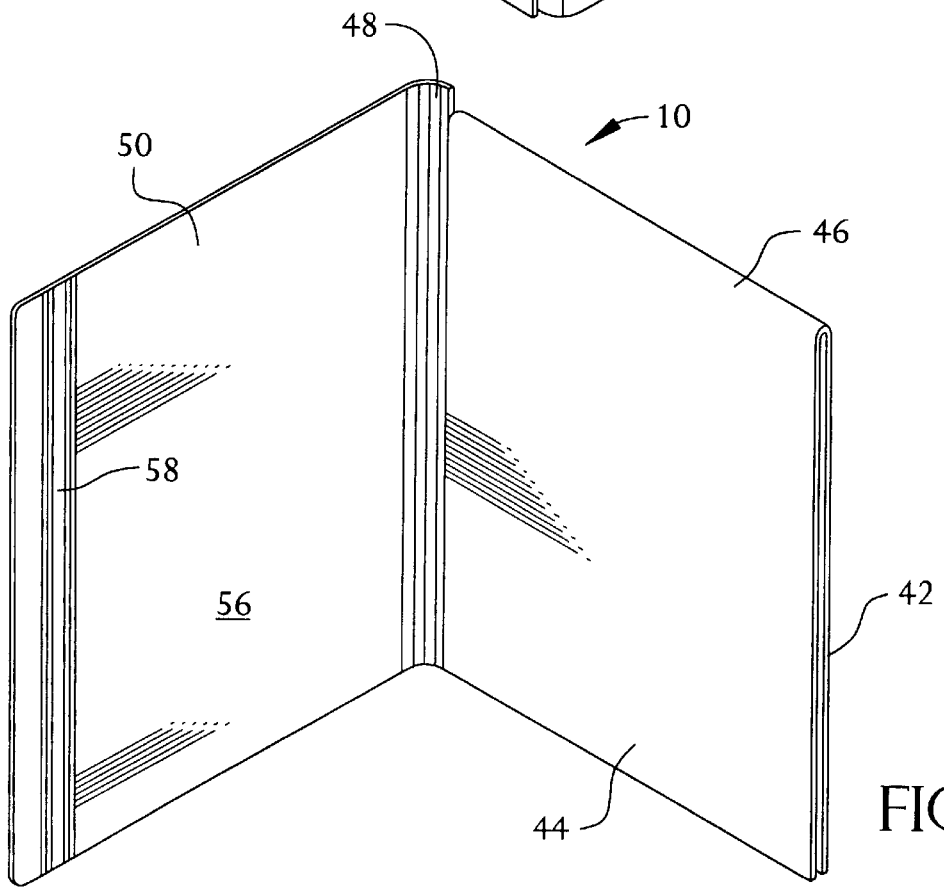

The insert 10 according to the invention is designed to fit unobtrusively into a conventional pad holder 12, that is, without preventing access to flap pocket 34 or pad 40. As best seen in FIG. 8, for example, insert 10 comprises a tongue 42 which is sized to fit into pocket 36 and to be inserted therein along with the back 38 of pad 40. Insert 10 further comprises a flap 44 hingedly attached to tongue 42 along an upper edge 46 of tongue 42. Preferably, tongue 42 and flap 44 are made of an integral piece of material, such as vinyl, which can conveniently be folded to form the hinged attachment between tongue 42 and flap 44. Alternatively, tongue 42 may be separate from flap 44 and the two pieces may be joined together by a heat seal, flexible tape or similar means of forming a hinged attachment. See e.g. FIG.15.

Flap 44 is in turn hingedly joined along a side edge 48 thereof to a holder means 50 for holding and storing articles. Preferably, holder means 50 has at least a portion integral with flap 44, so that holder means 50 can be folded relative to flap 44 to form the hinged attachment therebetween. Alternatively, holder means 50 may be separate from flap 44 and hingedly joined to it by a heat seal, flexible tape, or similar means of forming a hinged attachment.

Figure 5:
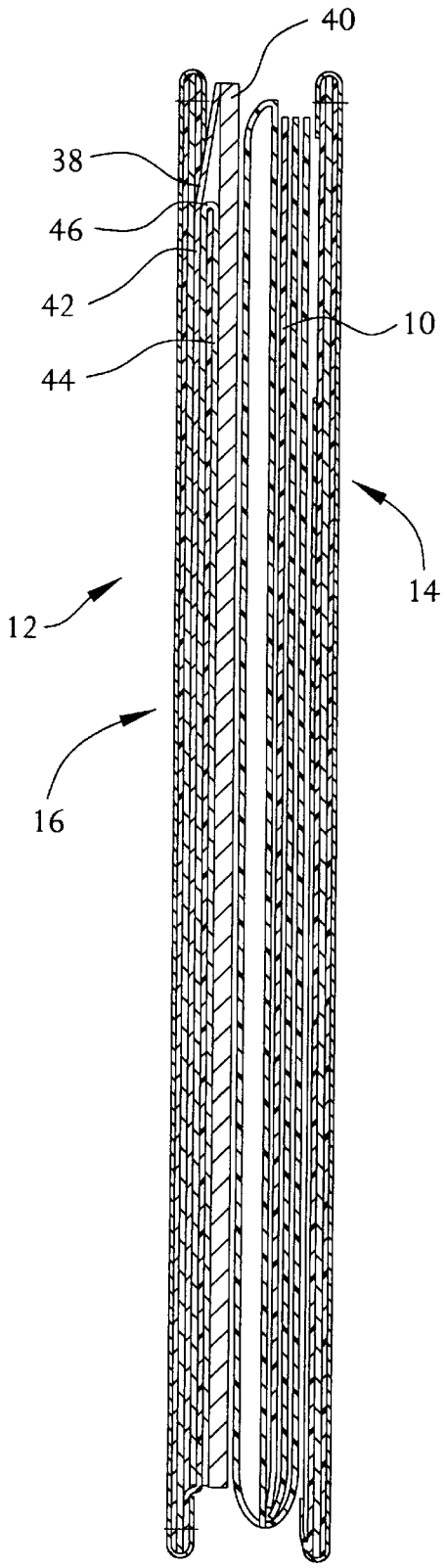
FIGS. 5 and 6 are sectional views taken along the line 5—5 in FIG. 2, FIG. 5 illustrating a single insert and FIG. 6 illustrating two inserts.

To use insert 12, pad 40 is temporarily removed from pad holder 12, and tongue 42 is inserted into pocket 36 in back cover 16. Then, flap 44 is folded to overlie inner layer 26 of back cover 16. Next, back 38 of pad 40 is inserted into pocket 36 between flap 44 and cardboard core 22, and the sheets of paper are arranged to overlie flap 44. The result is that insert 10 is located in pad holder 12 as shown in FIGS. 1, 3 and 5. When properly located in pad holder 12, insert 10 is held securely in place by pad 40. At the same time, holder means 50 is pivotable, by means of hinged attachment to flap 44 along edge 48, with respect to pad 40, so that a user has free access to flap pocket 34, pad 40 and holder means 50.

Figure 4:
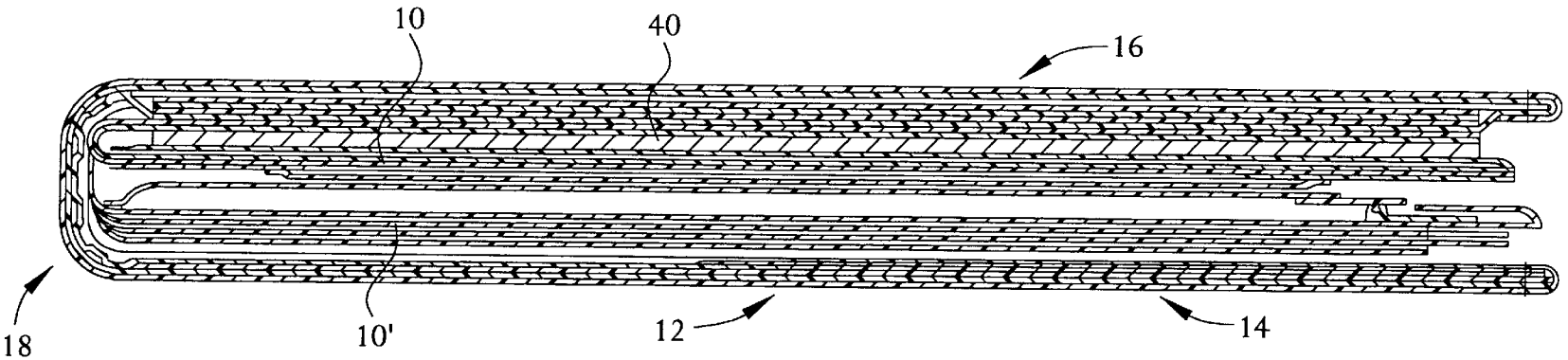
Figure 6:
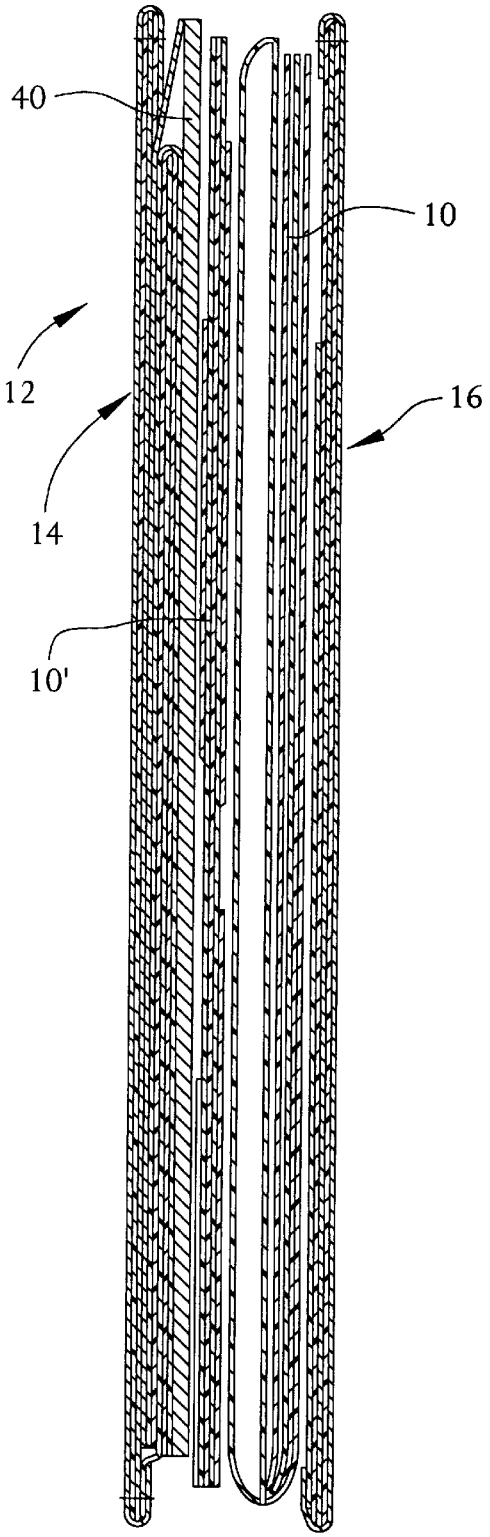

If desired, more than one insert may be placed in pad holder 12, such as second insert 10' as illustrated in FIGS. 4 and 6. The same steps as described above are followed to place additional inserts in pocket 36.

It will be appreciated that holder means 50 may have any desired form or configuration as may be desired for different storage uses, without departing from the scope of the invention. Thus, for example, while several different forms of insert are illustrated in the figures, the invention is not limited to the forms shown, and encompasses other forms not illustrated.

Figure 7:
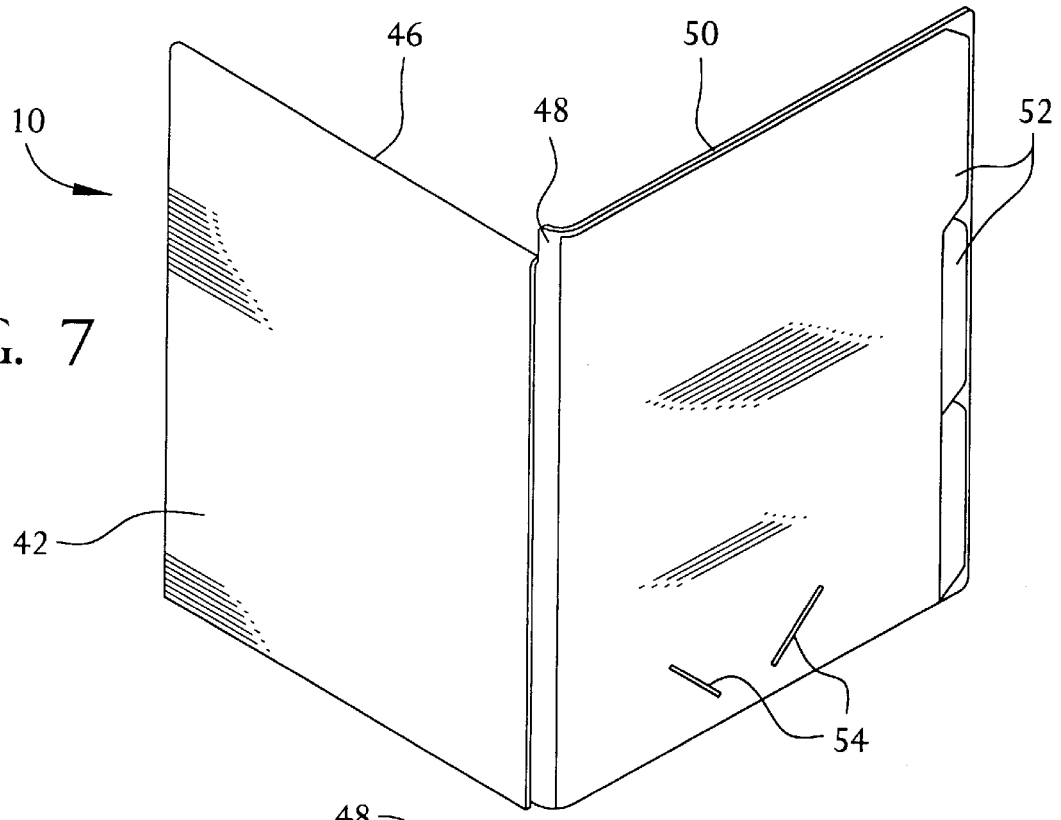

As examples of forms of holder means, FIGS. 7 and 8 illustrate a holder means one side of which comprises a plurality of file-cut flap pockets 52 for filing loose papers under different categories. Slits 54 may also be provided in the outer flap to hold business cards, for example. On the opposite side of the holder means is provided a zippered pocket 56, with a press-to-close zipper 58, in well-known manner.

FIGS. 9 and 10 illustrate a holder means which includes a plurality of pockets 60, 62 and 64, sized to hold different-sized articles. For example, pocket 60 may hold 5 ¼" computer diskettes, pocket 62 may hold loose papers, and pockets 64 may hold 3 ½" computer diskettes.

Figure 11:
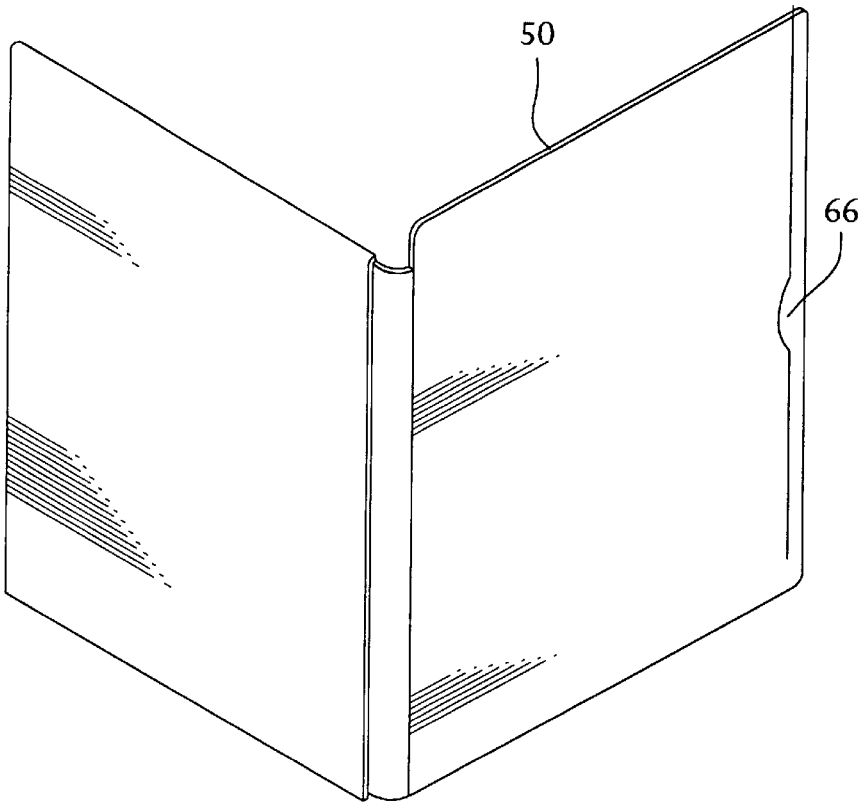
Figure 12:
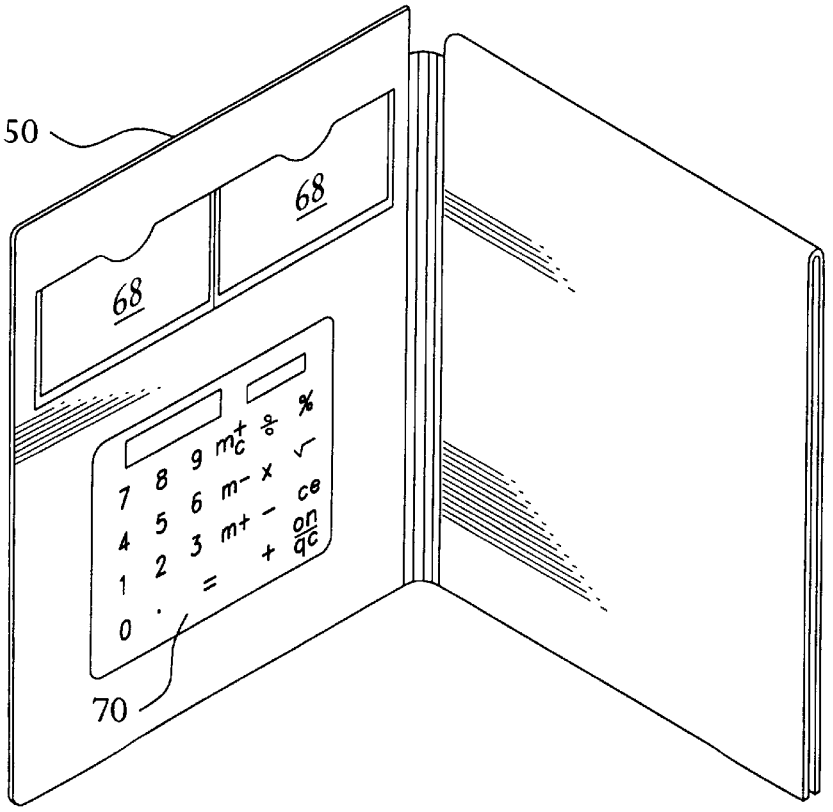

FIGS. 11 and 12 illustrate a holder means with one large pocket 66 on one side, several smaller pockets 68, and a calculator 70 on the other side.

Figure 13:
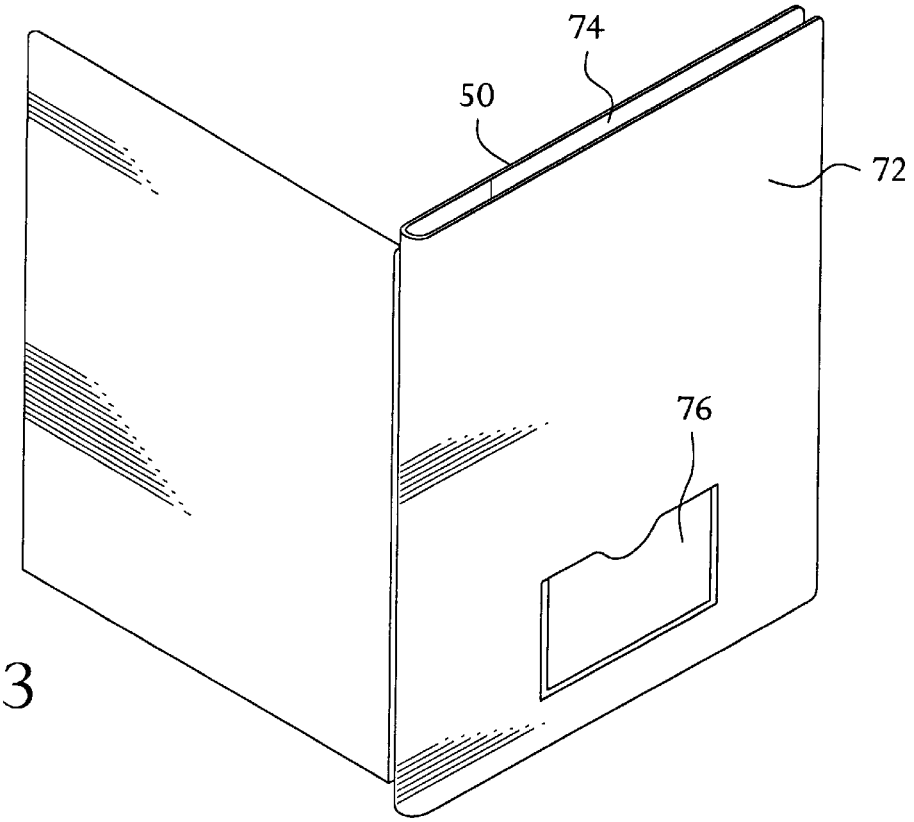
Figure 14:
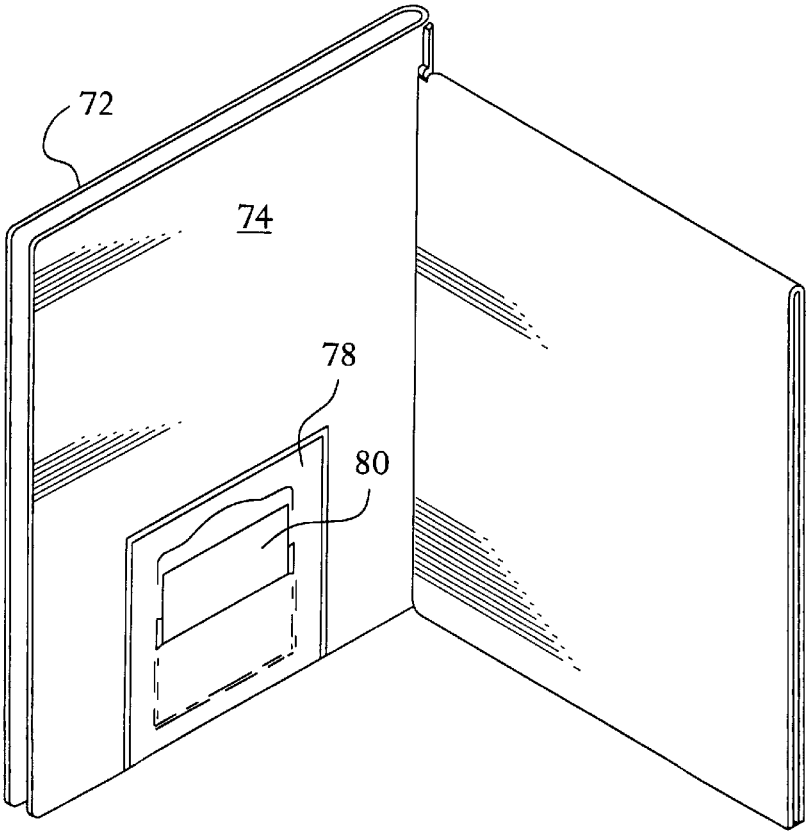

FIGS. 13 and 14 illustrate a holder means with a pair of covers for receiving and holding an appointment book and/or personal telephone directory. If desired, cover 72 may also be provided with a small pocket 76 to hold a business card, for example, and cover 74 may be provided with a pocket 78 to hold and dispense tack-adhesive note sheets 80.

Figure 15:
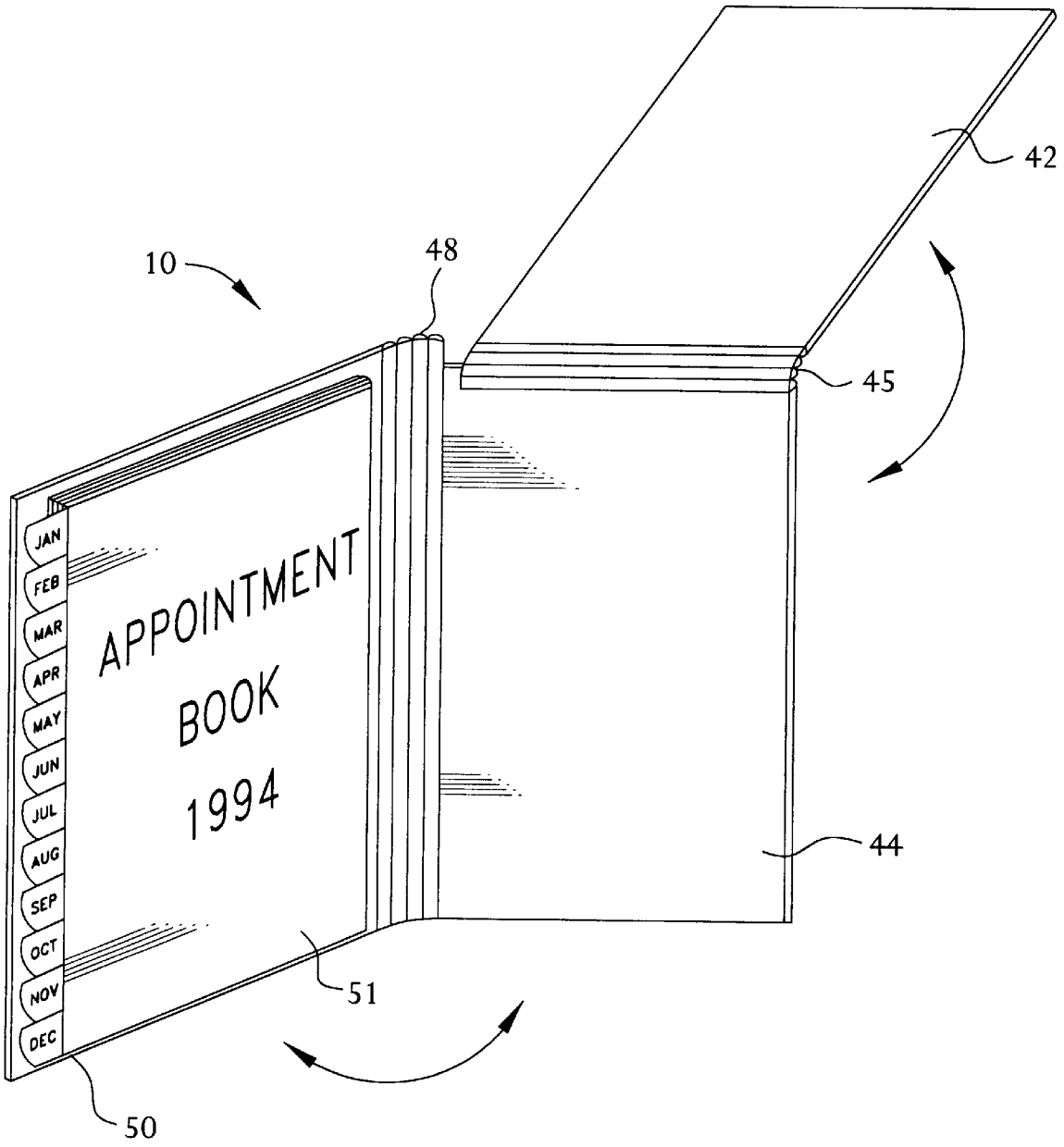

FIG. 15 illustrates a holder means wherein tongue 42 is separate from flap 44. These two separate pieces are joined together by hinge 45. Hinge 45 can be a heat seal, flexible tape or similar hinging means.

Figure 16:
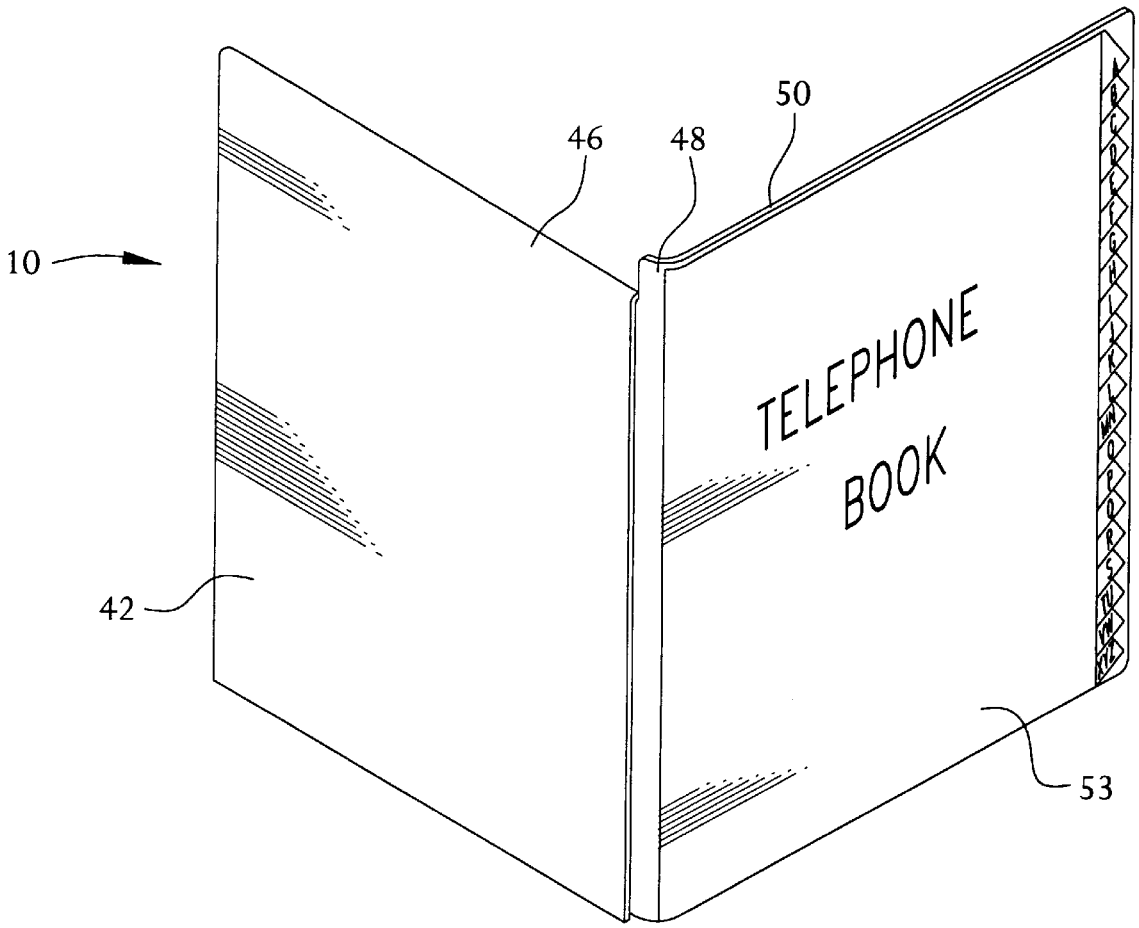
Figure 17:
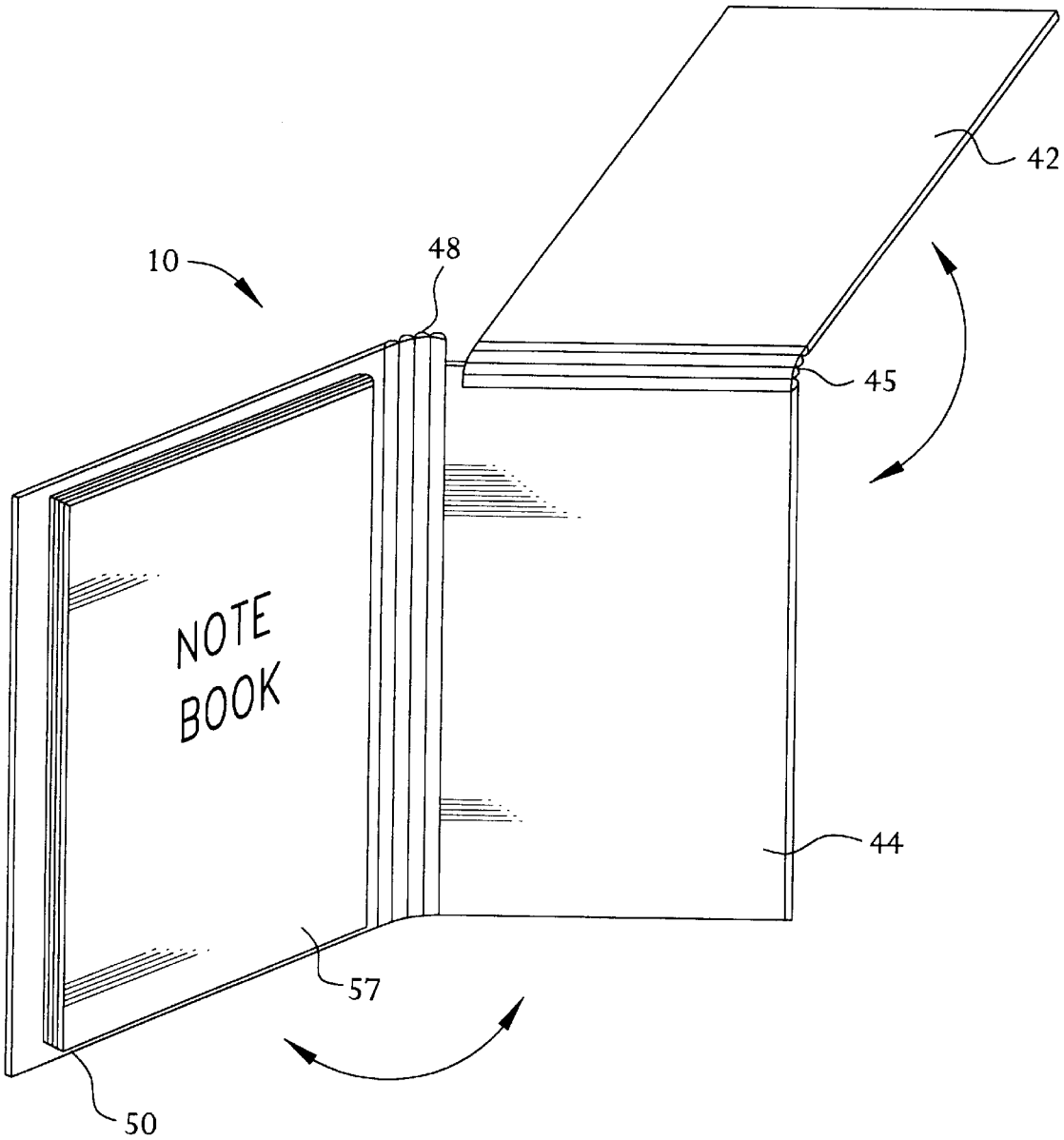

In FIG. 15, the holder means includes an appointment book 51. On the other hand, in FIG. 16, the holder means includes a telephone book 53; and FIG. 17 illustrates an embodiment of the invention wherein the holder means comprises a notebook 57.

The particular form of holder means 50 is not limited, and may have any or all of the features described above, in addition to features not described, without departing from the invention.

The present invention may be embodied in other specific forms without departing from the spirit or essential attributes thereof and, accordingly, reference should be made to the appended claims, rather than to the foregoing specification, as indicating the scope of the invention.

What is claimed is:

1. An insert for a pad holder, wherein said pad holder includes a front and a back cover joined by a vertically-oriented hinge such that said pad holder is pivotable between an opened and closed position, wherein said pad holder has a horizontally-oriented slit defined near the top of its front cover's or back cover's inside surface, and wherein the horizontally-oriented slit is dimensioned such that it can receive a writing pad's backer, said insert comprising:

(a) a tongue dimensioned to fit into said pad holder's horizontally-oriented slit, (b) a flap hingely joined to said tongue along said flap's upper edge by a horizontally-oriented hinge which permits said flap to be folded along a horizontal axis over said tongue, and (c) holder means for holding or storing articles, (i) said holder means being hingely joined to said flap along said holder means' side edge by a vertically-oriented hinge which permits said holder means to be folded along a vertical axis over said flap, and (ii) said holder means being configure to lie between said pad holder's front and back cover when said tongue is inserted into said pad holder's horizontally-oriented slit, when said flap is folded alone a horizontal axis over said tongue, when said holder means is folded along a vertical axis over said flap, and when said pad holder is in its closed position.

2. An insert as in claim 1, wherein said tongue, said flap and said holder means comprise a substantially integral sheet of material.

3. An insert as in claim 1, wherein said tongue and said flap comprise a substantially integral sheet of material, and said holder means comprises a separate piece joined to said flap by hinge means.

4. An insert as in claim 3, wherein said hinge means comprises a flexible one-piece hinge.

5. An insert as in claim 1, wherein said holder means comprises at least one flap pocket.

6. An insert as in claim 1, wherein said holder means comprises at least one closable pocket.

7. An insert as in claim 1, wherein said holder means comprises at least one flap pocket and at least one closable pocket.

8. An insert as in claim 1, wherein said holder means comprises a plurality of pockets.

9. An insert as in claim 8, wherein said pockets are all the same size.

10. An insert as in claim 8, wherein said pockets are of at least two different sizes.

11. An insert as in claim 1, wherein said holder means includes a calculator.

12. An insert as in claim 1, wherein said holder means comprises a plurality of pockets, at least one pocket having a size appropriate for containing a calculator.

13. An insert as in claim 1, wherein said holder means includes a book.

14. An insert as in claim 13, wherein the book is an appointment book.

15. An insert as in claim 13, wherein the book is a telephone directory.

16. An insert as in claim 13, wherein the book is a note-book.

* * * * *